US010580563B2

(12) United States Patent
Jeong

(10) Patent No.: US 10,580,563 B2
(45) Date of Patent: Mar. 3, 2020

(54) COIL COMPONENT

(71) Applicant: SAMSUNG ELECTRO-MECHANICS CO., LTD., Suwon-si, Gyeonggi-do (KR)

(72) Inventor: Dong Jin Jeong, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 19 days.

(21) Appl. No.: 15/183,099

(22) Filed: Jun. 15, 2016

(65) Prior Publication Data

US 2017/0117082 A1 Apr. 27, 2017

(30) Foreign Application Priority Data

Oct. 27, 2015 (KR) ..... 10-2015-0149165

(51) Int. Cl.

| | |
|---|---|
| ***H01F 5/00*** | (2006.01) |
| ***H01F 27/255*** | (2006.01) |
| ***H01F 1/36*** | (2006.01) |
| ***H01F 17/00*** | (2006.01) |
| ***H01F 17/04*** | (2006.01) |
| ***H01F 27/29*** | (2006.01) |
| *H01F 1/26* | (2006.01) |

(52) U.S. Cl.

CPC ..... *H01F 27/255* (2013.01); *H01F 1/36* (2013.01); *H01F 17/0013* (2013.01); *H01F 17/04* (2013.01); *H01F 27/292* (2013.01); *H01F 1/26* (2013.01)

(58) Field of Classification Search

USPC ..... 336/233

See application file for complete search history.

(56) References Cited

U.S. PATENT DOCUMENTS

| | | | | |
|---|---|---|---|---|
| 6,356,181 | B1 * | 3/2002 | Kitamura | H01F 17/0013 336/200 |
| 7,920,043 | B2 * | 4/2011 | Nakagawa | H01F 1/26 29/602.1 |
| 2012/0234767 | A1 * | 9/2012 | Fukaya | B03C 1/01 210/695 |
| 2013/0033347 | A1 * | 2/2013 | Matsuura | H01F 17/0013 336/83 |

(Continued)

FOREIGN PATENT DOCUMENTS

| | | |
|---|---|---|
| JP | 6-112034 A | 4/1994 |
| JP | 2006-080166 A | 3/2006 |

(Continued)

OTHER PUBLICATIONS

Office Action issued in corresponding Korean Application No. 10-2015-0149165, dated Jun. 19, 2017; with English translation.

*Primary Examiner* — Ronald Hinson

(74) *Attorney, Agent, or Firm* — Morgan, Lewis & Bockius LLP

(57) ABSTRACT

A coil component includes: a coil part; and a body formed around the coil part and containing a magnetic material. The body contains a first magnetic powder particle having a first insulating film formed on a surface thereof, and a second magnetic powder particle having a second insulating film formed on a surface thereof, and an average thickness of the first insulating film is thicker than that of the second insulating film.

18 Claims, 3 Drawing Sheets

(56) References Cited

U.S. PATENT DOCUMENTS

| | | | | |
|---|---|---|---|---|
| 2013/0154784 | A1* | 6/2013 | Hachiya | H01F 5/003 336/200 |
| 2014/0184374 | A1 | 7/2014 | Park et al. | |
| 2015/0028983 | A1 | 1/2015 | Ryu et al. | |
| 2016/0155550 | A1* | 6/2016 | Ohkubo | H01F 1/24 336/233 |

FOREIGN PATENT DOCUMENTS

| | | | |
|---|---|---|---|
| JP | 2010-251600 | A | 11/2010 |
| KR | 10-2014-0015074 | A | 2/2014 |
| KR | 10-2014-0085997 | A | 7/2014 |
| KR | 10-2015-0014346 | A | 2/2015 |

* cited by examiner

COIL COMPONENT

CROSS-REFERENCE TO RELATED APPLICATION

This application claims the benefit of priority to Korean Patent Application No. 10-2015-0149165, filed on Oct. 27, 2015 with the Korean Intellectual Property Office, the entirety of which is incorporated herein by reference.

BACKGROUND

The present disclosure relates to a coil component.

An inductor, which is a type of coil component, is a representative passive element configuring an electronic circuit, together with a resistor and a capacitor, to remove noise therefrom.

Thereamong, a thin film type inductor is commonly manufactured by forming a coil conductor by plating, forming a body by curing a magnetic powder-resin composite obtained by mixing a magnetic powder and a resin with each other on and below the coil conductor, and then forming external electrodes on external surfaces of the body.

In accordance with the recent trend toward increases in complexity, multifunctionalization, slimness, and the like, research into miniaturizing thin film type inductors has been continuously conducted. When thin film type inductors are manufactured to have a relatively small size, however, the volume of a magnetic material implementing component characteristics may be decreased, and thus permeability and DC bias characteristics may be deteriorated. Therefore, a method capable of preventing such characteristics from being deteriorated in spite of the trend toward miniaturization as described above has been required.

SUMMARY

An aspect of the present disclosure provides a coil component having excellent product characteristics.

According to an aspect of the present disclosure, a coil component includes a body containing a first magnetic powder particle and a second magnetic powder particle of which average thicknesses of insulating films formed on surfaces are different from each other.

According to an aspect of the present disclosure, a coil component includes: a coil part; and a body formed around the coil part and containing a magnetic material. The body contains a first magnetic powder particle having a first insulating film formed on a surface thereof, and a second magnetic powder particle having a second insulating film formed on a surface thereof, and an average thickness of the first insulating film is thicker than that of the second insulating film.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
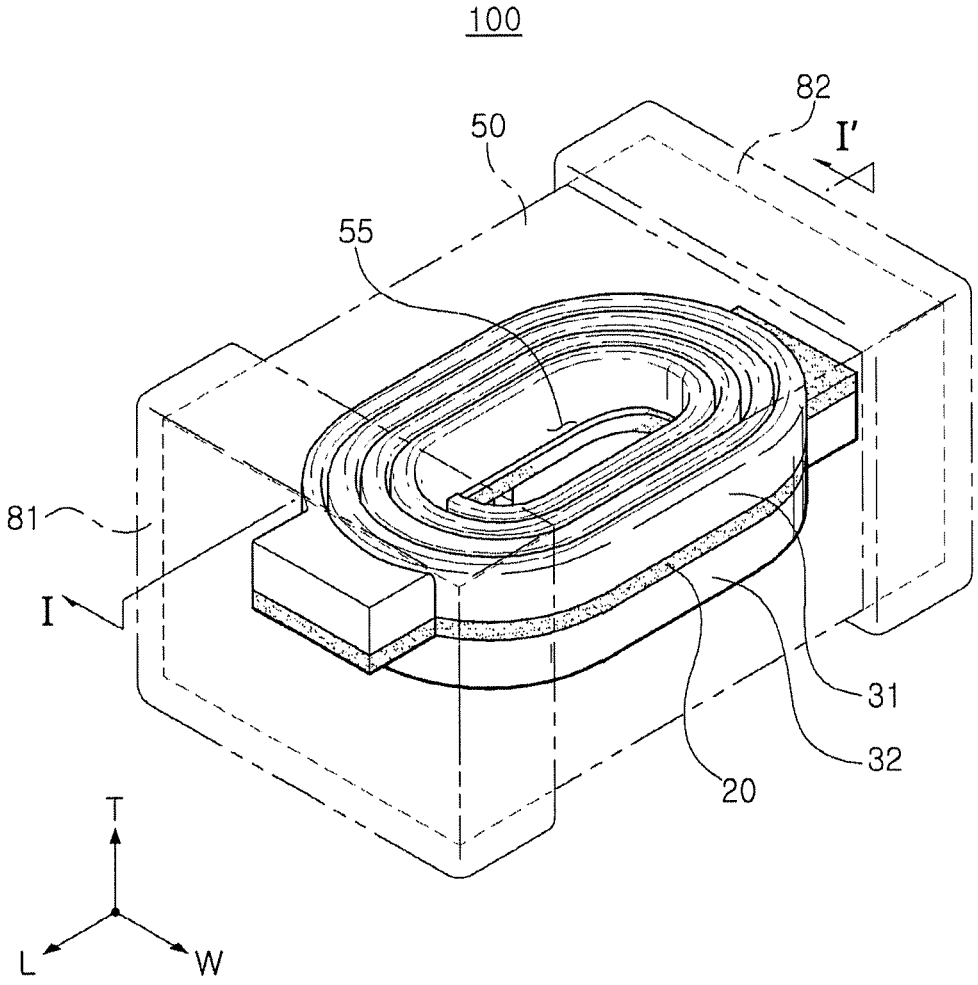
FIG. 1 is a perspective view schematically illustrating a coil component according to an exemplary embodiment in the present disclosure so that a coil part thereof is visible.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on, " "directly connected to," or "directly coupled to" another element, there may be no other elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship relative to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present disclosure. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

Hereinafter, a coil component according to an exemplary embodiment in the present disclosure, particularly, a thin film type inductor, will be described by way of example. However, the coil component according to the exemplary embodiment is not necessarily limited thereto.

FIG. 1 is a perspective view schematically illustrating a coil component according to an exemplary embodiment in the present disclosure so that a coil part thereof is visible. Based on FIG. 1, a 'length' direction refers to an 'L' direction of FIG. 1, a 'width' direction refers to a 'W' direction of FIG. 1, and a 'thickness' direction refers to a 'T' direction of FIG. 1.

Referring to FIG. 1, a coil component 100 according to the exemplary embodiment in the present disclosure may include a coil part and a body 50 formed around the coil part and containing a magnetic material.

The coil part may include a first coil conductor 31 formed on a first surface of a substrate 20, and a second coil conductor 32 formed on a second surface of the substrate 20 opposing the first surface thereof.

The first and second coil conductors 31 and 32 may be planar coils having a spiral shape.

The first and second coil conductors 31 and 32 may be formed on the substrate 20 by an electroplating method. However, a method of forming the first and second coil conductors 31 and 32 is not necessarily limited thereto, but any method known in the art may be used as long as a similar effect may be exhibited.

The first and second coil conductors 31 and 32 may be formed of a metal having excellent electric conductivity, for example, silver (Ag), palladium (Pd), aluminum (Al), nickel (Ni), titanium (Ti), gold (Au), copper (Cu), platinum (Pt), or alloys thereof. However, the material forming first and second coil conductors 31 and 32 is not necessarily limited thereto.

The first and second coil conductors 31 and 32 may be coated with an insulating film 40 to thereby not directly contact a magnetic material forming the body 50. The insulating film 40 may contain one or more selected from the group consisting of epoxy, polyimide, and a liquid crystalline polymer, but is not necessarily limited thereto.

One end portion of the first coil conductor 31 may be extended to form a first lead portion 31' (not illustrated), and the first lead portion 31' maybe exposed to one end surface of the body 50 in the length (L) direction. Further, one end portion of the second coil conductor 32 may be extended to form a second lead portion 32' (not illustrated), and the second lead portion 32' may be exposed to the other end surface of the body 50 in the length (L) direction. However, the first and second lead portions 31' and 32' are not necessarily limited thereto, but may be exposed to at least one surface of the body 50.

The substrate 20 may be, for example, a polypropylene glycol (PPG) substrate, a ferrite substrate, a metal based soft magnetic substrate, or the like. A through hole may be formed in a central portion of the substrate 20, and filled with a magnetic material, thereby forming a core part 50. In a case in which the core part 55 filled with the magnetic material is formed as described above, an area of the magnetic material through which magnetic flux passes may be increased, and thus, inductance L may be further improved.

However, the substrate 20 is not necessarily included, and the coil part may be formed using a metal wire without the substrate.

The coil component 100 according to the example embodiment in the present disclosure may further include first and second external electrodes 81 and 82 formed on external surfaces of the body 50, and connected to the coil conductors 31 and 32. In this case, the first lead portion 31' of the first coil conductor 31 may be connected to the first external electrode 81, and the second lead portion 32' of the second coil conductor 32 may be connected to the second external electrode 82.

The first and second external electrodes 81 and 82 may be formed of a metal having excellent electric conductivity. For example, the first and second external electrodes 81 and 82 may be formed of one of nickel (Ni), copper (Cu), tin (Sn), silver (Ag), and the like, alloys thereof, or the like.

Plating layers (not illustrated) may be formed on the first and second external electrodes 81 and 82. In this case, the plating layers may contain one or more selected from the group consisting of nickel (Ni), copper (Cu), and tin (Sn). For example, nickel (Ni) layers and tin (Sn) layers may be sequentially formed.

Figure 2:
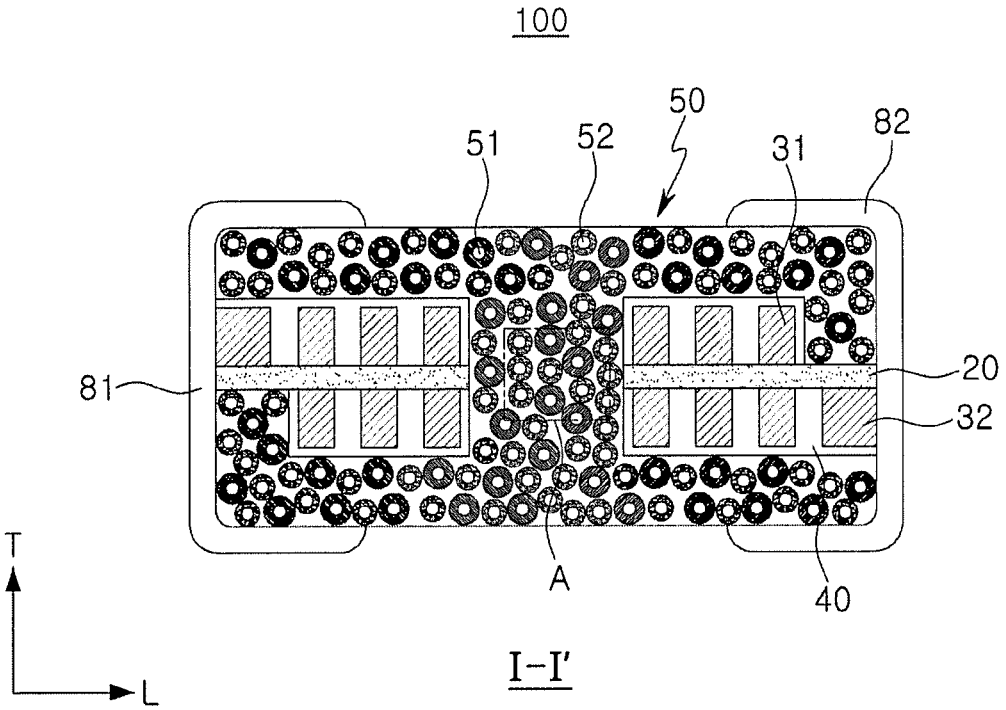
FIG. 2 is a cross-sectional view of the coil component taken along line I-I' of FIG. 1.
Figure 3:
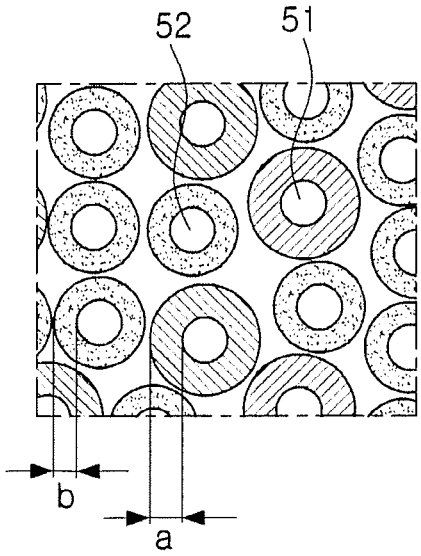
FIG. 3 is an enlarged view of a part A of FIG. 2.

FIG. 2 is a cross-sectional view of the coil component taken along line I-I' of FIG. 1, and FIG. 3 is an enlarged view of a part A of FIG. 2.

Referring to FIGS. 2 and 3, the body 50 may contain a first magnetic powder particle 51 and a second magnetic powder particle 52 having insulating films are formed on surfaces thereof. Insulation properties between particles may be secured by forming the insulating films on the surfaces of the magnetic powder particles as described above.

The first magnetic powder particle 51 and the second magnetic powder particle 52 having the insulating films formed on the surfaces thereof may be dispersed and contained in a thermosetting resin. In this case, the thermosetting resin may be, for example, an epoxy resin, a polyimide resin, or the like, but is not necessarily limited thereto.

Average thicknesses of the insulating films formed on the surfaces of the first magnetic powder particle 51 and the second magnetic powder particle 52 may be different from each other. In this case, the average thickness of the insulating film formed on the first magnetic powder particle 51 may be thicker than that of the insulating film formed on the second magnetic powder particle 52.

As the body 50 may contain the first magnetic powder particle 51 and the second magnetic powder particle 52 of which the average thicknesses of the insulating films are different from each other, a content of the magnetic powder contained in the same volume may be significantly increased, and thus, permeability and DC bias characteristics may be significantly improved.

The average thickness of the insulating film formed on the first magnetic powder particle 51 may be within the range of 10 nm or more but 40 nm or less. In a case in which the average thickness of the insulating film formed on the first magnetic powder particle 51 is less than 10 nm, a fine current path may be formed between the powder particles in the body due to deterioration of insulating properties, and in a case in which the average thickness is greater than 40 nm, permeability of the body may be deteriorated.

Further, the average thickness of the insulating film formed on the second magnetic powder particle 52 may be within the range of 1 nm or more but 10 nm or less. In a case in which the average thickness of the insulating film formed on the second magnetic powder particle 52 is less than 1 nm, a fine current path may be formed between the powder particles in the body due to deterioration of the insulation property, and in a case in which the average thickness is more than 10 nm, permeability of the body may be deteriorated.

Here, the average thickness may be measured through high-magnification scanning electron microscope (SEM) analysis.

The first magnetic powder particle 51 and the second magnetic powder particle 52 having the insulating films formed on the surfaces thereof may be contained in a weight ratio of 1:9 to 9:1. In a case in which the weight ratio is lower than 1:9, insulation resistance of the body may be deteriorated. On the contrary, in a case in which the weight ratio is higher than 9:1, permeability of the body may be deteriorated.

The first magnetic powder particle 51 and the second magnetic powder particle 52 may have various particle sizes depending on the purpose of the present disclosure. For example, the first magnetic powder particle 51 and the second magnetic powder particle 52 may have a diameter within the range of 0.1 μm to 90 μm. Further, the first magnetic powder particle 51 and the second magnetic powder particle 52 may be spherical particles.

The first magnetic powder particle 51 and the second magnetic powder particle 52 may be ferrite powder particles or metal powder particles having magnetic characteristics.

As a specific example, the ferrite powder may be one or more selected from the group consisting of Mn—Zn based ferrite powder, Ni—Zn based ferrite powder, Ni—Zn—Cu based ferrite powder, Mn—Mg based ferrite powder, Ba based ferrite powder, and Li based ferrite powder.

Further, the metal powder may contain one or more selected from the group consisting of iron (Fe), silicon (Si), boron (B), chromium (Cr), aluminum (Al), copper (Cu), niobium (Nb), and nickel (Ni). For example, the metal powder may be Fe—Si—B—Cr based amorphous metal powder, but is not necessarily limited thereto.

The first magnetic powder particle 51 and the second magnetic powder particle 52 may be the same type of magnetic powder or different types of magnetic powder particles.

A glass transition temperature (Tg) of the insulating films formed on surfaces of the first magnetic powder particle 51 and the second magnetic powder particle 52 may be 120° C. or more. In a case in which the glass transition temperature (Tg) of the insulating film is lower than 120° C., the insulating film may be volatilized to thereby be lost during while the body is formed.

The insulating film formed on the surfaces of the first magnetic powder particle and the second magnetic powder particle may contain one or more selected from the group consisting of epoxy, polyimide, acrylic, Teflon, and a liquid crystalline polymer (LCP), but is not necessarily limited thereto.

Figure 4:
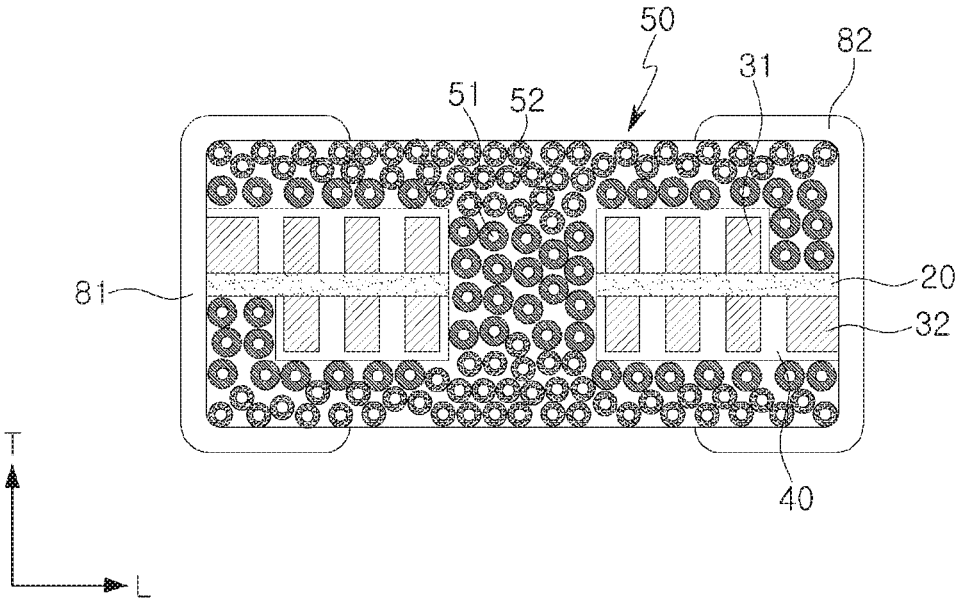
FIG. 4 is a cross-sectional view of a coil component according to another exemplary embodiment in the present disclosure.

FIG. 4 is a cross-sectional view of a coil component according to another exemplary embodiment in the present disclosure.

A body 50 of the coil component according to the present exemplary embodiment in the present disclosure may be formed by stacking a plurality of magnetic layers on and below a coil part, and among the plurality of magnetic layers, a magnetic layer adjacent to the coil part may contain the first magnetic powder particle 51 of which the relatively thicker insulating film is formed on the surface, and the other magnetic layers may contain the second magnetic powder particle 52 of which the relatively thinner insulating film is formed on the surface thereof.

In a case in which the first magnetic powder particle of which the average thickness of the insulating film is thick is disposed in a region adjacent to the coil part as described above, excellent electric insulation property may be secured in a high-voltage and high-current environment.

Figure 5:
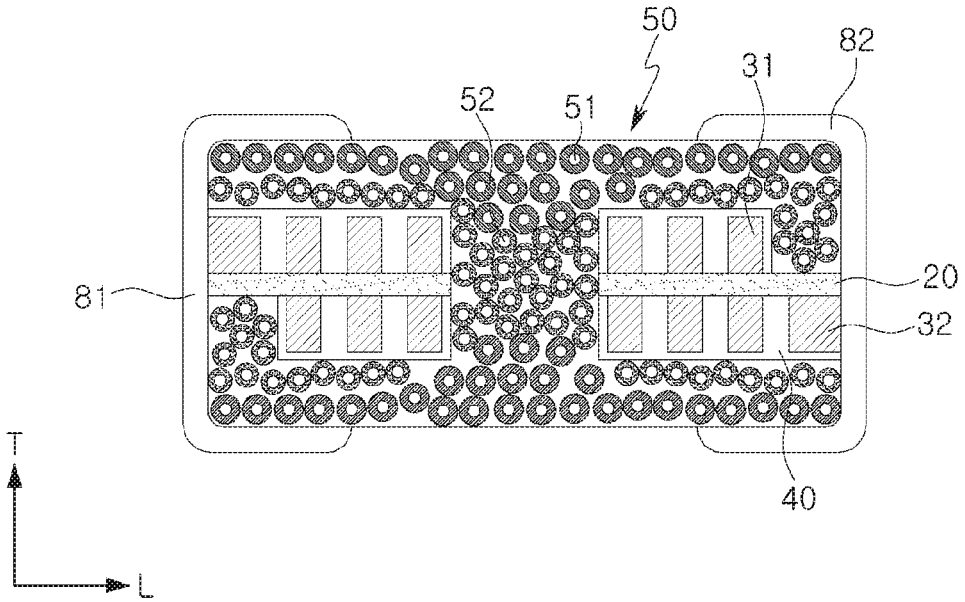
FIG. 5 is a cross-sectional view of a coil component according to another exemplary embodiment in the present disclosure.

FIG. 5 is a cross-sectional view of a coil component according to another exemplary embodiment in the present disclosure.

A body 50 of the coil component according to another exemplary embodiment in the present disclosure may be formed by stacking a plurality of magnetic layers on and below a coil part, and among the plurality of magnetic layers, a magnetic layer adjacent to the coil part may contain the second magnetic powder particle 52 of which the relatively thinner insulating film is formed on the surface, and the other magnetic layers may contain the first magnetic powder 51 particle of which the relatively thicker insulating film is formed on the surface thereof.

In a case in which the second magnetic powder particle of which the average thickness of the insulating film is thin is disposed in a region adjacent to the coil part, a high degree of inductance may be secured due to high permeability of the body.

EXPERIMENTAL EXAMPLE

The following Table 1 illustrates results obtained by testing permeability and DC bias characteristics depending on the type of magnetic powder contained in a body of a coil component.

Sample 1 was manufactured by stacking a total of eight metal magnetic layers containing Fe—Cr—Si based metal powder (average particle diameter: 23 μm) of which phosphate based glass (glass transition temperature: 310° C.) having an average thickness of 30 nm was formed on a surface, and then compressing and curing the stacked metal magnetic layers.

Sample 2 was manufactured by stacking a total of eight metal magnetic layers containing an Fe—Cr—Si based metal powder (average particle diameter: 23 μm) of which phosphate based glass (glass transition temperature: 310° C.) having an average thickness of 5 nm was formed on a surface, and then compressing and curing the stacked metal magnetic layers.

Sample 3 was manufactured by stacking a total of eight metal magnetic layers containing Fe—Cr—Si based metal powder (average particle diameter: 23 μm) of which phosphate based glass (glass transition temperature: 310° C.) having an average thickness of 30 nm was formed on a surface and Fe—Cr—Si based metal powder (average particle diameter: 23 μm) of which phosphate based glass (glass transition temperature: 310° C.) having an average thickness of 5 nm was formed on a surface at a ratio of 5:5, and then compressing and curing the stacked metal magnetic layers.

TABLE 1

| Sample | Permeability | DC Bias Characteristics |
|---|---|---|
| 1* | 25 | 2.8A |
| 2* | 32 | 2.1A |
| 3 | 35 | 2.8A |

*Comparative Example

Referring to Table 1, it may be appreciated that in a case of forming a body using two types of magnetic powder particles of which average thickness of insulating films were different from each other, permeability and DC bias characteristics were significantly improved.

As set forth above, according to exemplary embodiments in the present disclosure, the coil component may have excellent permeability and DC bias characteristics.

While exemplary embodiments have been shown and described above, it will be apparent to those skilled in the art that modifications and variations could be made without departing from the scope of the present invention as defined by the appended claims.

What is claimed is:

1. A coil component comprising:

a coil part; and a body disposed around the coil part and containing a magnetic material, wherein the body contains first magnetic powder particles each having a first insulating film disposed on a surface thereof, and second magnetic powder particles each having a second insulating film disposed on a surface thereof, an average particle diameter of the first magnetic powder particles is the same as an average particle diameter of the second magnetic powder particles with an average particle diameter within a range from 10 μm to 90 μm, and an average thickness of the first insulating film is greater than an average thickness of the second insulating film.

2. The coil component of claim 1, wherein the body includes a plurality of magnetic layers on and below the coil part, and among the plurality of magnetic layers, a magnetic layer adjacent to the coil part contains the first magnetic powder particle, and the other magnetic layers contain the second magnetic powder particle.

3. The coil component of claim 1, wherein the body includes a plurality of magnetic layers on and below the coil part, and among the plurality of magnetic layers, a magnetic layer adjacent to the coil part contains the second magnetic powder particle, and the other magnetic layers contain the first magnetic powder particle.

4. The coil component of claim 1, wherein the average thickness of the first insulating film is within the range of 10 nm to 40 nm.

5. The coil component of claim 1, wherein the average thickness of the second insulating film is within the range of 1 nm to 10 nm.

6. The coil component of claim 1, wherein the average thickness of the first insulating film is within the range of greater than 10 nm to 40 nm, and the average thickness of the second insulating film is within the range of 1 nm to less than 10 nm.

7. The coil component of claim 1, wherein the body contains the first magnetic powder particle and the second magnetic powder particle having the insulating films disposed on the surfaces thereof, respectively, in a weight ratio within the range of 1:9 to 9:1.

8. The coil component of claim 1, wherein the first magnetic powder particle and the second magnetic powder particle contain one or more selected from the group consisting of MnZn based ferrite, Ni—Zn based ferrite, Ni—Zn—Cu based ferrite, Mn—Mg based ferrite, Ba based ferrite, and Li based ferrite.

9. The coil component of claim 1, wherein the first magnetic powder particle and the second magnetic powder particle contain one or more selected from the group consisting of iron (Fe), silicon (Si), boron (B), chromium (Cr), aluminum (Al), copper (Cu), niobium (Nb), and nickel (Ni).

10. The coil component of claim 1, wherein a glass transition temperature (Tg) of the first and second insulating films is 120° C. or more.

11. The coil component of claim 1, wherein the first and second insulating films contain one or more selected from the group consisting of epoxy, polyimide, acrylic, Teflon, and a liquid crystalline polymer (LCP).

12. The coil component of claim 1, wherein the first magnetic powder particle and the second magnetic powder particle are dispersed in a thermosetting resin.

13. The coil component of claim 1, wherein the coil part includes a substrate and first and second coil conductors disposed on first and second surfaces of the substrate, respectively.

14. The coil component of claim 13, further comprising first and second external electrodes disposed on external surfaces of the body and connected to the first and second coil conductors, respectively.

15. The coil component of claim 13, wherein the first and second coil conductors are coated with an insulating film.

16. The coil component of claim 15, wherein the insulating film contains one or more selected from the group consisting of epoxy, polyimide, and a liquid crystalline polymer.

17. The coil component of claim 13, wherein the substrate includes polypropylene glycol (PPG), ferrite, or a metal based soft magnetic material.

18. The coil component of claim 13, wherein a through hole is arranged in a central portion of the substrate and filled with a magnetic material to form a core part.

* * * * *